US006598493B2

(12) United States Patent
Kohlhase

(10) Patent No.: US 6,598,493 B2
(45) Date of Patent: Jul. 29, 2003

(54) MULTIPLE CRANK DRIVE FOR WORKING MACHINES, IN PARTICULAR FOR DIAPHRAGM PUMPS

(75) Inventor: Niels Kohlhase, Leonberg (DE)

(73) Assignee: LEWA Herbert Ott GmbH & Co., Leonberg (DE)

( * ) Notice: Subject to any disclaimer, the term of this patent is extended or adjusted under 35 U.S.C. 154(b) by 0 days.

(21) Appl. No.: 09/854,494

(22) Filed: May 15, 2001

(65) Prior Publication Data

US 2001/0042422 A1 Nov. 22, 2001

(30) Foreign Application Priority Data

May 18, 2000 (DE) ..... 100 24 546

(51) Int. Cl.[7] ..... F16H 21/34
(52) U.S. Cl. ..... 74/44; 74/49; 74/595
(58) Field of Search ..... 74/595, 49, 44

(56) References Cited

U.S. PATENT DOCUMENTS

| | | | | | |
|---|---|---|---|---|---|
| 1,994,397 | A | * | 3/1935 | Loveridge et al. | 418/169 |
| 3,570,459 | A | * | 3/1971 | Combs | 123/197.4 |
| 5,009,580 | A | * | 4/1991 | Maru | 417/533 |
| 5,158,046 | A | * | 10/1992 | Rucker | 123/197.4 |
| 5,180,346 | A | * | 1/1993 | Carriere | 475/198 |
| 5,649,809 | A | * | 7/1997 | Stapelfeldt | 417/63 |
| 6,006,619 | A | * | 12/1999 | Gindentuller et al. | 123/197.1 |

* cited by examiner

*Primary Examiner*—David A. Bucci
*Assistant Examiner*—Julie K. Smith
(74) *Attorney, Agent, or Firm*—Jacobson Holman PLLC

(57) ABSTRACT

A multiple crank drive for working machines, in particular for diaphragm pumps, with a crankshaft, which is disposed in a housing and which exhibits at lest two bearings, can be driven by a drive, in particular a gear, and in turn drives by a crank drive, one of several piston rods of the working machines. The drive is designed in such a manner that the crankshaft is suspended in the housing.

2 Claims, 1 Drawing Sheet

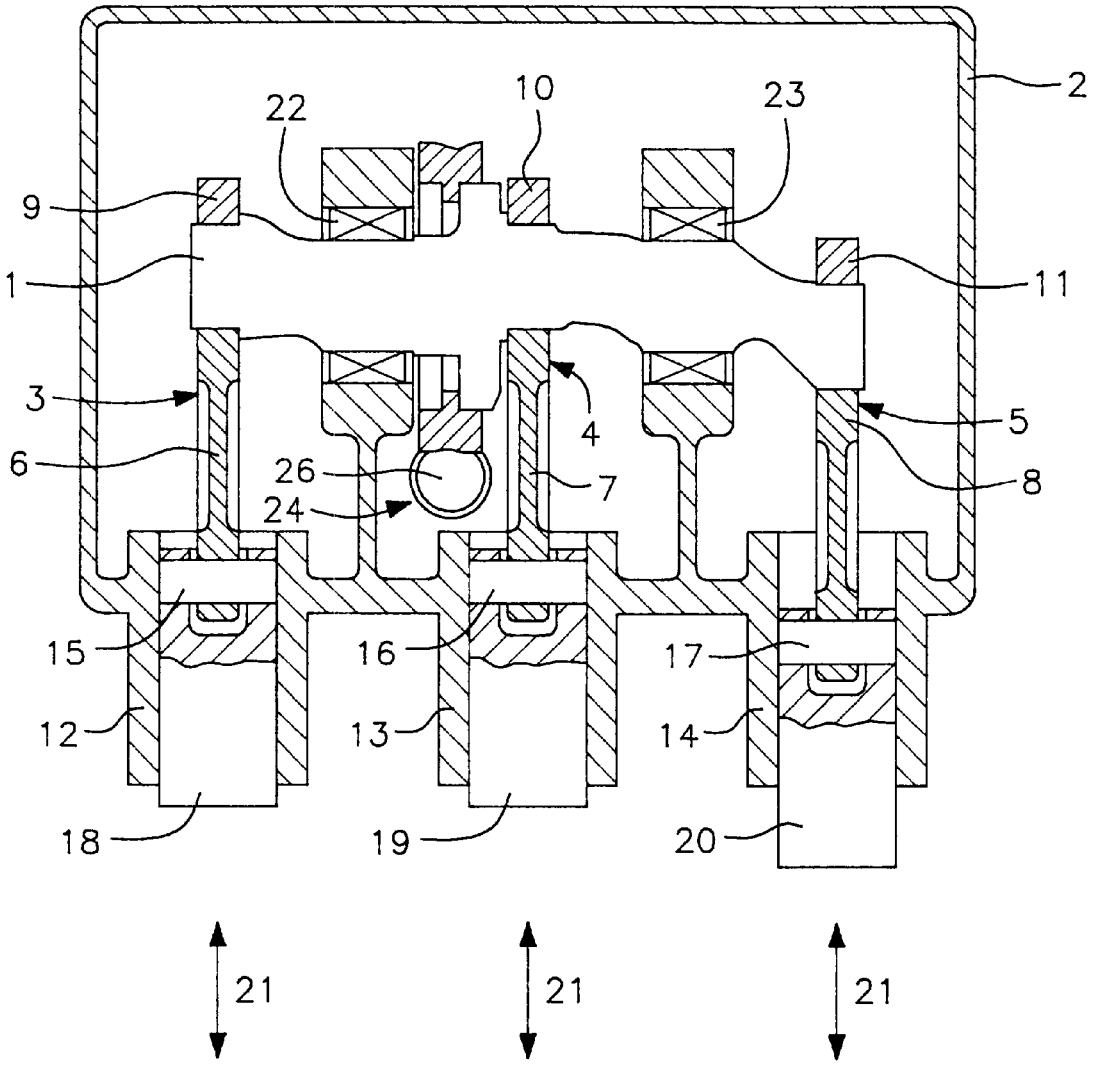
2
10
22
23
9
1
11
3
4
5
6
26
7
8
24
15
16
17
12
13
14
18
19
20
21
21
21

MULTIPLE CRANK DRIVE FOR WORKING MACHINES, IN PARTICULAR FOR DIAPHRAGM PUMPS

FIELD OF THE INVENTION

The invention relates to a multiple crank drive for working machines, in particular for diaphragm pumps.

BACKGROUND OF THE INVENTION

This class of prior art multiple crank drive, which is used to drive several working machines, which are arranged side by side and are connected together, in particular, for example, for so called triplex diaphragm pumps, is usually designed in such a manner that there is a common crankshaft, on which the individual crank drives, usually comprising eccentric, connecting rod, connecting rod head, etc., are spaced apart. The two ends of this crankshaft, which exhibits automatically a significant length owing to the working machines, arranged side by side, are disposed in a housing by means of a bearing. Owing to this automatically longer length of the crankshaft, it must also be relatively strong. That is, it is designed with an adequately large diameter. In addition, there is significant stress on the bearing, a feature that also necessitates correspondingly a bearing of large dimensions.

This stress is also increased due to the fact that the drive for the crankshaft, in particular a worm gear, is also mounted on the crankshaft and is usually located in the interior of the housing in the vicinity of an end-sided bearing of the crankshaft.

SUMMARY OF THE INVENTION

Therefore, the invention is based on the problem of designing this class of multiple crank drive so that the aforementioned drawbacks are remedied. To this end, the crankshaft is built shorter, can be provided with a smaller diameter and finally generates only lower stress on the bearing.

The invention is based on the important idea of suspending the crankshaft, serving to drive multiple working machines, in the housing. In a preferred embodiment of the invention this means that the bearing of the multiple crank drive is located exclusively on both sides of the central crank drive.

For this reason the crankshaft does not need any end sided pins, which served hitherto the mounting, so that the crankshaft can be built altogether shorter and thus can also be provided with a smaller diameter. The result is also the important advantage of less bearing stress, so that bearings with small dimensions can also be provided.

In a practical embodiment this means that in an otherwise identical configuration a crankshaft, which exhibited in the past a length of 2.10 meters, can be built with a length of 1.50 meters.

Another advantageous reduction in the length of the crankshaft results when, according to the invention, the drive for the multiple crank drive is disposed between two crank drives. Preferably the drive is also located in the vicinity of a bearing.

Thus, the invention achieves, on the whole, significant design advantages, which have in the final analysis a beneficial effect on the price structure of the entire arrangement.

BRIEF DESCRIPTION OF THE DRAWINGS

The invention is explained in detail below in the form of one embodiment with reference to the single drawing. It is a longitudinal view of a multiple crank drive, according to the invention.

DETAILED DESCRIPTION OF THE PREFERRED EMBODIMENTS

The drawing shows a multiple crank drive for driving several working machines, preferably triplex diaphragm pumps, which are not depicted in detail and are arranged side by side. Said multiple crank drive exhibits a crankshaft 1, which is disposed in a housing 2.

In the illustrated embodiment the crankshaft 1 serves to drive three working machines, which are arranged side by side, and is provided correspondingly with three individual crank drives 3, 4, 5. Each crank drive exhibits a connecting rod 6, 7, 8, which is hinged, on the one hand, to an eccentric disk 9 or 10 or 11, attached to the crankshaft, and, on the other hand, to a connecting rod head 15, 16, 17, which can be slid in a cylindrical guide 12, 13, 14.

A piston rod 18, 19, 20 can be hinged to the connecting rod heads 15, 16, 17. Said piston rod can be moved back and forth in the direction of the double arrow 21 owing to the effect, exerted by the crankshaft 1, thus driving the attached working machines.

As evident from the drawing, the crankshaft 1 is suspended in the housing 2. For this purpose the two bearings 22, 23 of the crankshaft 1, which are disposed otherwise on the respective end of the crankshaft 1 and are fixed in position in the side walls of the housing, are located exclusively on both sides of the central crank drive 4. In the illustrated embodiment, these two bearings 22, 23, are fastened, as evident from the drawing, on the floor of the housing 2. Thus it is possible to build the crankshaft 1 significantly shorter, since it is no longer necessary to provide end sided crankshaft pins to mount in the side walls of the housing 2. At the same time the diameter of the crankshaft can be kept correspondingly smaller, a feature that reduces altogether the stress on the bearings 22, 23.

The drive 24 for the crankshaft 1, which is provided in the form of a gear 26 in the illustrated embodiment and is located usually on the inside of one of the two faces of the housing 2, is arranged between two crank drives, in the concrete embodiment between the central crank drive 4 and the crank drive 3, which is on the left of said central crank drive 4, and, in particular, in the vicinity of the bearing 22.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

I claim:

1. Multiple crank drive for a triplex diaphragm pump, said multiple crank drive comprising:

a crankshaft disposed in a housing, the crankshaft including at least two bearings and the crankshaft being driven by a drive including a gear, and in turn the crankshaft drives by a respective crank drive of a plurality of crank drives one of several piston rods of the triplex diaphragm pump, terminal ends of the crankshaft being suspended in the housing by said bearings and spaced inwardly of the housing, said bearings being located exclusively on both sides of a central one of the crank drives, and said drive, including the gear, being arranged between two of the crank drives as well as between one crank drive of the two crank drives and one of the bearings.

2. multiple crank drive, as claimed in claim 1, wherein the drive including the gear is located adjacent to the one of the at least two bearings.

* * * * *